US007264521B2

(12) United States Patent
Gardner

(10) Patent No.: US 7,264,521 B2
(45) Date of Patent: Sep. 4, 2007

(54) BIOMECHANICALLY CORRECT PEDAL POWERED PADDLING SYSTEM FOR SMALL WATERCRAFTS

(76) Inventor: Wilson Gardner, 436 St. Nicholas Street, Sudbury, Ontario (CA) P3E 3K4

( * ) Notice: Subject to any disclaimer, the term of this patent is extended or adjusted under 35 U.S.C. 154(b) by 12 days.

(21) Appl. No.: 10/714,956

(22) Filed: Nov. 18, 2003

(65) Prior Publication Data

US 2005/0106954 A1 May 19, 2005

(51) Int. Cl.
*B63H 16/20* (2006.01)
*B63H 16/00* (2006.01)

(52) U.S. Cl. ..... 441/27; 440/21

(58) Field of Classification Search ..... 440/26, 440/27, 32

See application file for complete search history.

(56) References Cited

U.S. PATENT DOCUMENTS

| | | | | | |
|---|---|---|---|---|---|
| 1,726,239 | A * | 8/1929 | Ruff | ..... | 440/27 |
| 3,259,098 | A * | 7/1966 | Knaver | ..... | 440/27 |
| 4,353,703 | A * | 10/1982 | d'Elloy | ..... | 440/21 |
| 4,960,396 | A * | 10/1990 | Stolzer | ..... | 440/21 |
| 5,584,732 | A * | 12/1996 | Owen | ..... | 440/13 |

* cited by examiner

*Primary Examiner*—Jesús D. Sotelo

(57) ABSTRACT

The present invention relates to an accessory system simulating the biomechanical motion of manual paddling such as with a canoe or small boat. The system comprises: a watercraft attaching portion having width-adjusting members, an array of levers and members, paddle attaching members, a pedal system, and linkage therebetween, all forming a mechanical structure adapted to simulate the biomechanical motion commonly used by manual-propulsion watercraft operators.

8 Claims, 4 Drawing Sheets

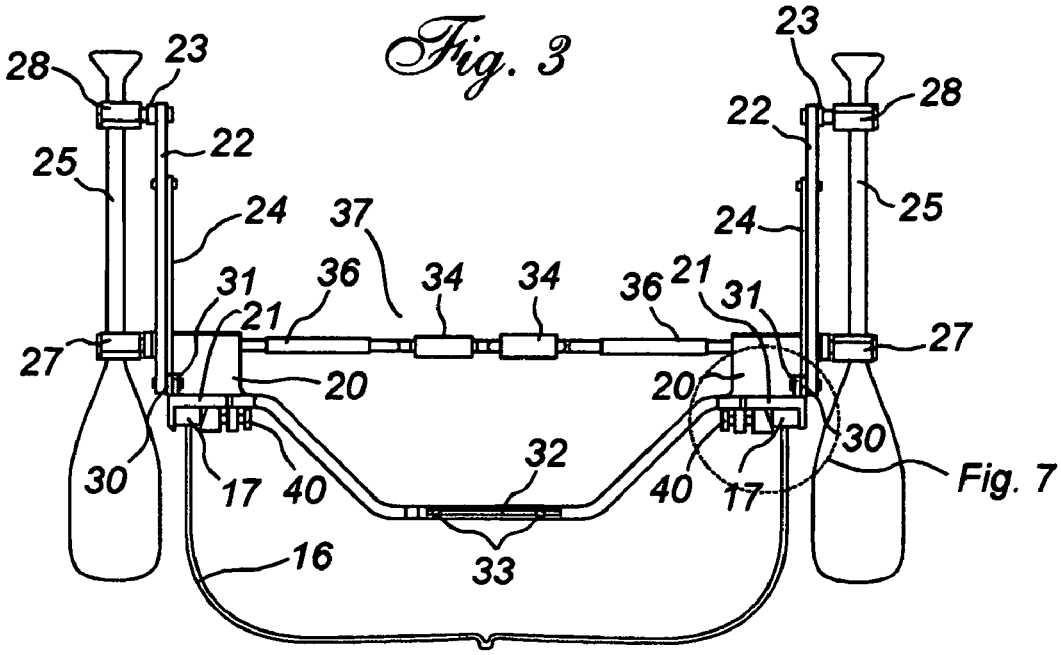
Fig. 3
28
23
22
25
24
37
31
36
34
34
36
21
31
21
27
20
20
27
30
17
40
32
40
17
30
Fig. 7
16
33
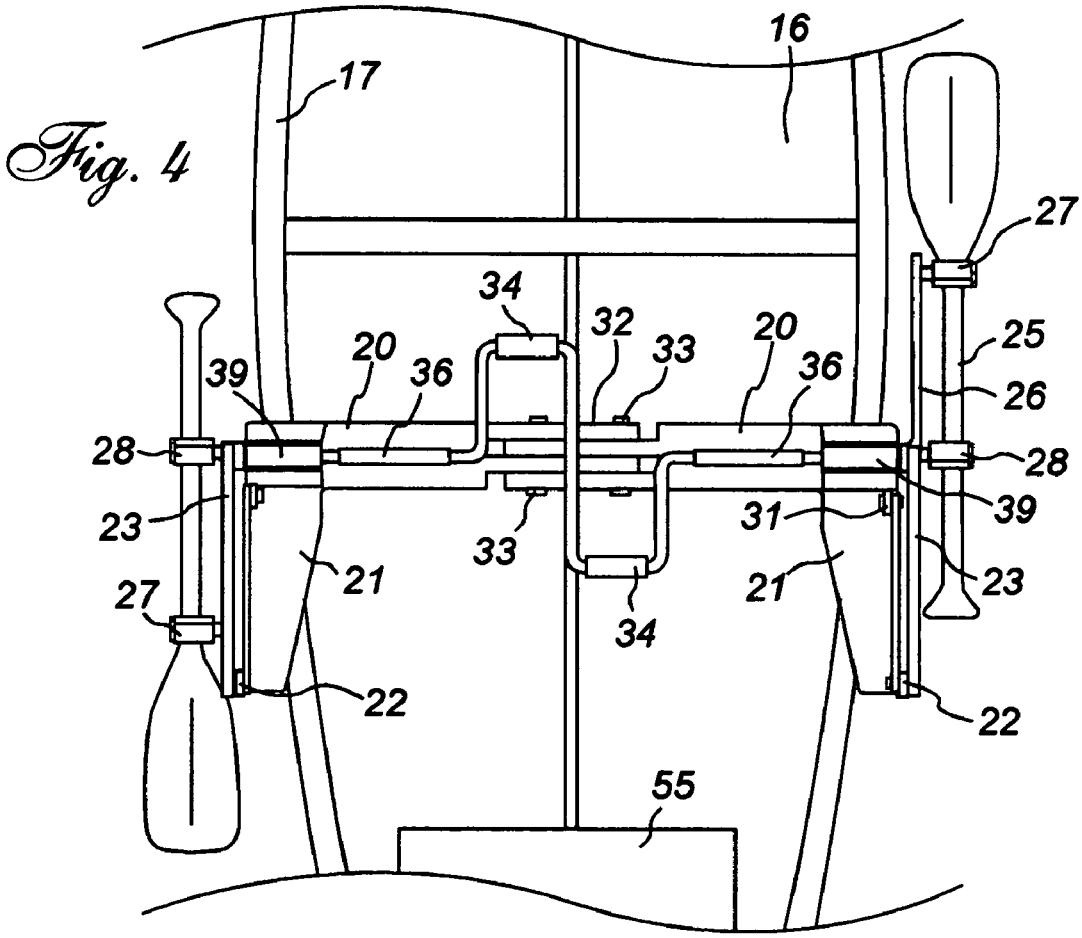
Fig. 4
16
17
27
34
32
33
20
36
20
36
25
26
39
28
28
23
31
39
33
21
21
23
27
34
22
22
55

BIOMECHANICALLY CORRECT PEDAL POWERED PADDLING SYSTEM FOR SMALL WATERCRAFTS

FIELD OF THE INVENTION

The present invention relates to an accessory system simulating the biomechanical motion of manual paddling such as with a canoe or small boat. The system comprises: a watercraft attaching frame having a width-adjustable joining portion, an array of levers and members, paddle attaching members, a pedal system, and linkage therebetween, all forming a mechanical structure adapted to simulate the biomechanical motion commonly used by operators paddling a small watercraft.

BACKGROUND OF THE INVENTION

For illustration purposes, the applicant will illustrate the use of the present invention as used on a conventional canoe. However, it will be understood that the invention, as described, is equally effective on small boats and similar watercrafts, which can commonly be propelled by use of conventional paddles.

The inventor sought to provide canoe operators with a system for not only propelling a canoe using pedal power from one's legs, but also with the ability to easily disable said system when not required, and particularly, simulate the biomechanical motion of canoe paddling thus optimizing water displacement, making the effort of paddling optimally efficient. Furthermore the present invention provides improvement in the art of pedal-propulsion systems designed for small watercraft. Most pedal propulsion systems aim to eliminate the need of manually paddling the watercraft by hand, or to replace electric or gas powered motors, which in turn drive propeller drives or paddle wheel assemblies. Existing pedal powered propulsion devices for small watercraft are usually attached to the watercraft in a fashion so that it could be removed at a later time. However, during the period of use, afloat in the water, the device is always attached in a way that in turn may limit the flexibility of travel for the watercraft. One such case is where the watercraft is required to traverse a narrow waterway or fixed obstacles in its path.

There are three basic categories of human-powered propulsion systems for small watercrafts, they are:

i. propeller driven,
ii. paddle wheel driven, and
iii. row-style driving devices.

Devices falling into categories (i) and (ii) develop problems with tangling of aquatic plants, damage to aquatic plants and to equipment. Devices falling into categories (ii) and (iii) are usually of a bulky nature and cumbersome, which take up space outside of the watercraft, in turn limiting the maneuverability of said watercraft.

In summary devices of category (i), propeller driven, have the following problems;

Pedal powered propeller drives are complicated and costly,
They are heavy, and
They can damage and become tangled in aquatic plants.

Category (ii) devices, paddle wheels, have the following problems;

Paddle wheels can grab aquatic plants and become tangled,
Entry and exit into and out of the water surface by a paddle wheel is not efficient,
They are noisy, They waste energy by splashing water outward from the wheel paddles,
Splash guards are required to keep the passengers dry,
They have a lower energy transfer efficiency,
They are heavy, and
Have a multiplicity of redundant paddles and structure to support them.

Category (iii) devices, rowing-style driving devices, have the following problems;

They are efficient but take up a large space, thus reducing maneuverability, and
They are heavy due to the structure required, Therefore, the applicant intends to overcome a majority of the problems associated with prior art human-powered propulsion system by providing a new improved biomechanically correct pedal powered paddling system for small watercrafts.

The applicant is aware of attempts in prior art to provide means of propelling small watercrafts using mechanically powered apparatuses.

An example of prior art may be had when referring to U.S. Pat. No. 5,584,732 of Owen, issued Dec. 17, 1996 depicting a part paddle attached to a mechanical linkage device powered by foot pedals. However, the device fails to compare with the present invention in that it propels the watercraft using a fish-tail motion know to be inefficient when adapted to a rigid body since it exerts a large portion of its force in a side to side motion.

Another example may be had in referring to U.S. Pat. No. 1,532,990 of Csengery, issued Apr. 7, 1925, which teaches of a boat having a rotary paddle apparatus adapted to propel said boat by hand power. This device fails to compare with the present invention in that it does not simulate the biomechanical motion of human paddling, as does the present invention.

Another example may be had in referring to U.S. Pat. No. 5,249,991 of Schinkel, issued Oct. 5, 1993, which depicts a manually operated propulsion device for a canoe comprising generally of a rotary paddle arrangement power by hand, again failing in that it does not simulate the biomechanical motion of human paddling.

SUMMARY OF THE INVENTION

It is thus the object of the present invention to provide canoe operators with a system for not only propelling a canoe using pedal power from one's legs, but also with the ability to easily disable said system when not required, and particularly, simulate the biomechanical motion of canoe paddling thus optimizing water displacement and efficiency.

In one aspect of the invention, the system synthesizes the natural manual paddle motion commonly used when paddling by hand.

In another aspect of the invention, the system's biomechanically correct simulation enhances the efficiency in power transfer by reducing drag while increasing paddle alignment.

In another aspect of the invention, the system of the present invention can easily collapse when use thereof is not desired.

In another aspect of the invention, the system can be quickly installed and removed from the watercraft in a matter of minutes without making alterations or modifications to said watercraft.

Accordingly, the system of the present invention provides canoe operators with a system for propelling a canoe using pedal power from one's legs, the ability to easily disable said system when not required, and particularly, simulates the biomechanical motion of canoe paddling thus optimizing water displacement a paddling efficiency.

BRIEF DESCRIPTION OF THE DRAWINGS

These and other advantages of the invention will become apparent upon reading the following brief description and upon referring to the drawings in which:

FIG. 3 is a cross-sectional view taken from FIG. 4 of the biomechanically correct pedal powered paddling system for small watercrafts of the present invention.

FIG. 4 is a partial top plan view of the biomechanically correct pedal powered paddling system for small watercrafts of the present invention.

Figure 1:
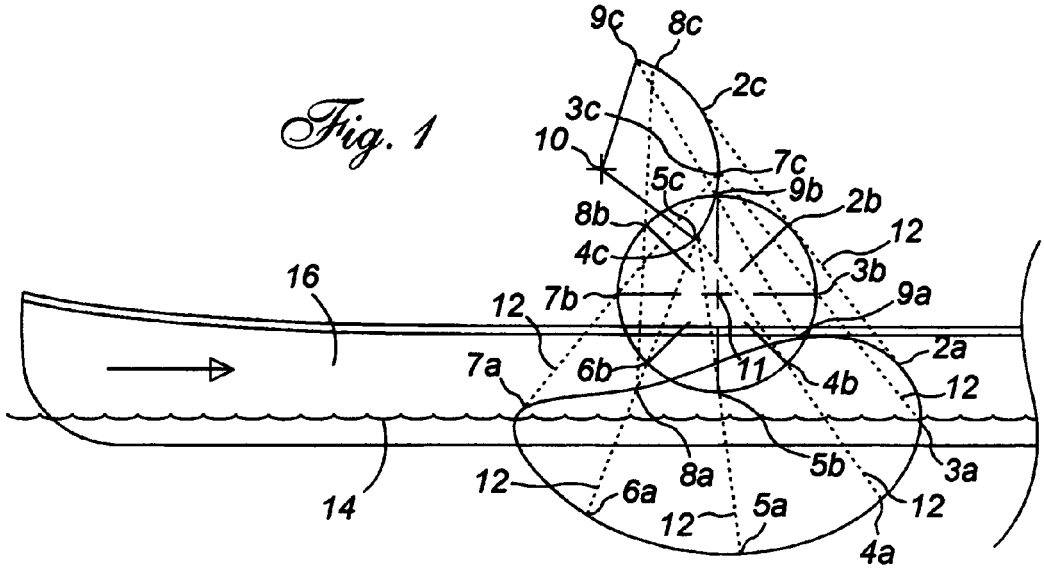
FIG. 1 is a left side elevation view of the orientational path of the biomechanically correct pedal powered paddling system for small watercrafts of the present invention.

While the invention is described in conjunction with preferred illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE PREFERRED EMBODIMENT

In the following description, similar features in the drawings have been given similar reference numerals.

Turning to the drawings, in particular, FIG. 1, which illustrates a left side elevation view of the orientational path of the biomechanically correct pedal-powered paddling system for small watercrafts of the present invention wherein members 12 represent the paddle, and each member 12 is of equal length, numerical FIGS. 2*x* to 9*x* (where x depict points a, b, and c) represent a fixed point on said paddle, where Xa (where X depicts 2, 3, 4 . . . 9) represents the tip of the paddle, Xb represents the lower pivot clamp fixed to a mid section of the paddle, and Xc represents the upper pivot clamp also fixed to the upper section of said paddle.

A paddle crank having a non-rotational female end adapted to receive the male end of a drive shaft, and a rotational end adapted to secure to a linkage attaching portion of the above paddle receiving portion rotates at a drive axis 11, and a swing lever rotates at a lever axis 10.

Upon following the path as illustrated in this Figure, one can comprehend the compound motion generated by this dual axis-dual pivot method of obtaining the biomechanically correct simulation of natural paddling motion. The system of the present invention therefore promotes optimal paddle entry to and exit from the water body 14 on which a canoe 16 is traveling.

Figure 2:
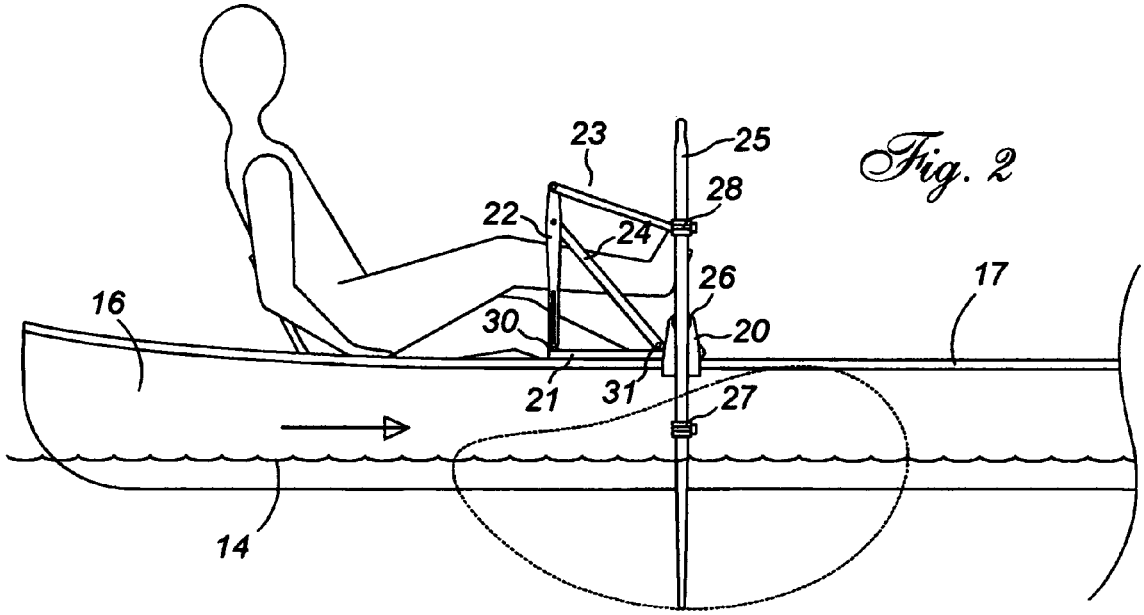
FIG. 2 is a left side elevation view of the biomechanically correct pedal powered paddling system for small watercrafts of the present invention in use.

Turning now to FIG. 2, a left side elevation view of the biomechanically correct pedal powered paddling system for small watercrafts of the present invention in use comprising; a watercraft attaching frame 20, a frame extension 21, a vertical arm member 22, an swing lever 23, a diagonal support member 24, a paddle 25, a drive crank 26, a lower paddle clamp 27 and an upper paddle clamp 28 wherein, the watercraft attaching frame 20 fixedly attaches to the gunwale portion 17 by means of a turn screw clamp, the frame extension 21 is integral with the watercraft attaching frame 20, the vertical arm member 22 is pivotally attached to a rear bracket 30 integral with the frame extension 21 and pivotally engaged with the rear portion of the swing lever 23, the swing lever 23 is also pivotally engaged to the upper paddle clamp 28, the diagonal support member 24 is pivotally attached to a front bracket 31 and to an upper-mid section of the vertical arm member 22 thereby forming a structural triangle rigidly supporting said vertical arm member 22, the paddle 25 is held in place by means of the lower paddle clamp 27 and the upper paddle clamp 28, and one end of the drive crank 26 is non-rotationally engage to the outermost end of the pedal drive assembly, and its other end pivotally engaged to the lower paddle clamp 27.

In reference now to FIG. 3, a cross-sectional view taken from FIG. 4 of the biomechanically correct pedal powered paddling system for small watercrafts of the present invention illustrating, in a different perspective, the assembly components of the system wherein, a watercraft attaching frame 20 is securedly yet releasably attached to the gunwale 17 of a small watercraft such as a canoe 16 as illustrated, using a turn-screw type clamp 40 thereby securing said frame 20 from movement at any axis in relation to the canoe 16. The watercraft attaching frame 20 is made to adjust to the varied width of conventional watercrafts by means of slotted multi-tongue members 32 adapted to slidably engage to each opposing frame member and secured to each other with bolts 33 thus creating a larger contact surface area thereby preventing displacement between each frame member. The frame 20, formed in two mirror opposite portions, each have a horizontal central portion, a diagonal portion extending upwardly and outwardly from the central portion, and a horizontal clamp portion, is so formed to allow sufficient clearance for rotational movement of the pedal members of the pedal assembly and said frame 20 is integral in maintaining vertical and horizontal parallel alignment to both left and right sides in respect to the alignment and shape of the watercraft.

Two frame extension portions 21 extending rearwardly from each upper outermost portion of said frame 20 integrally include a front bracket 31 and a rear bracket 30 wherein the front bracket 31 serves to rotationally attach the lower portion of a diagonal support 24, and the rear bracket 30 serves to also rotationally attach the lower portion of a vertical arm 22 on which the upper portion of the diagonal support 24 in turn rotationally attaches to a perforation in the upper-mid section of the vertical member 22 thereby resulting is a triangular structure formed between the frame extension 21, the vertical member 22 and the diagonal support 24. Pedal drive extensions 36 having deep female end and a male end wherein the female end having a generally square inner form is adapted to slidably but non-rotationally engage with the outer surface of the pedal drive 37, and the male end of the pedal drive extension is partly threaded to accept a nut after traversing the crank arm 26 thus preventing rotational freedom of crank arm with pedal drive extension 36.

A swing lever 23 having a perforation near each end, rotationally attaches at one end of said lever 23 to the uppermost perforation of the vertical member 22, and the opposing end of said lever 23 securedly attached to pivoting member of the upper paddle clamp 28.

The upper paddle clamp 28 and lower paddle clamp 27 frictionally attach to a conventional paddle and said paddle clamps 28 and 27 comprise: a paddle receiving portion, a locking member, an axle member and a linkage attaching portion.

Turning now to FIG. 4, a partial top plan view of the biomechanically correct pedal powered paddling system for small watercrafts of the present invention illustrating the assembly components of the system comprising: a watercraft attaching frame 20 securedly yet releasably attached to the gunwale 17 of a small watercraft such as a canoe 16 as illustrated. The watercraft attaching frame 20 is made to adjust to the varied width of conventional watercrafts by means of slotted multi-tongue members 32 adapted to slidably engage to each opposing frame member and secured to each other with bolts 33 thus creating a larger contact surface area thereby preventing displacement between each frame member.

Two frame extension portions 21 extending rearwardly from each upper outermost portion of said frame 20 integrally include a front bracket 31 and a rear bracket wherein the front bracket 31 serves to rotationally attach the lower portion of a diagonal support 24, and the rear bracket serves to also rotationally attach the lower portion of a vertical arm 22 on which the upper portion of the diagonal support 24 in turn rotationally attaches to a perforation in the upper-mid section of the vertical member 22 thereby resulting is a triangular structure formed between the frame extension 21, the vertical member 22 and the diagonal support 24.

A drive crank 26 is non-rotationally engage to the outermost end of the pedal drive assembly, and its other end pivotally engaged to the lower paddle clamp 27 thus, when rotational force is created by a paddler, the pedal assembly thereby rotates the drive crank 26, which in turn exerts a rotational force at an arm motion on upper paddle clamps 28 rotationally attached to the ends of the drive crank 26. Said paddle clamps 27, when frictionally attached to the lower mid portion of a conventional paddle 25, form a basis of the compound motion of the system of the present invention, which synthesizes to natural motion of arm-powered paddling.

The upper paddle clamp 28 and lower paddle clamp 27 frictionally attach to a conventional paddle and said paddle clamps 28 and 27 comprise: a paddle receiving portion, a locking member, an axle member and a linkage attaching portion. The pedal drive extensions 36 having deep female end and a male end wherein the female end having a generally square inner form is adapted to slidably but non-rotationally engage with the outer surface of the pedal drive 37, and the male end of the pedal drive extension 36 is partly threaded to accept a nut after traversing the crank arm 26 thus preventing rotational freedom of crank arm with pedal drive extension 36.

Therefore, it can be understood that a paddler, seated (55) within the watercraft 16, places his feet one on each pedal 34 at the pedal drive assembly 37, and supports himself by holding the gunwales 17 of said watercraft 16, pedals as he would a bicycle to drive the attached crank arm 26, which is rotably engaged to the lower mid section of a conventional canoe paddle 25 by means of a pivotal lower paddle clamps 27, and said canoe paddle 25 is pivotally engaged to a swing lever 23 by means of a pivotal upper paddle clamp 28, which said upper paddle clamp 28 being attached to said swing lever 23 and said swing lever 23 opposing end being pivotally attached to a vertical arm 22 supported by a diagonal support 24 thereby, when the drive crank 26 is rotated, the lower paddle clamp 27 simply moves in a continually rotational movement equal in radius to the center to center of both perforations in the drive crank 26, and the upper paddle clamp 28 movement is thereby limited to an arc of a tangent generally equal to twice the radius of the crank arm 26. Therefore, the combination of these movements for a compound action at the tip of a paddle 25 closely synthesizes the natural motion of conventional arm-powered paddling but is powered by the user's legs.

Figure 5:
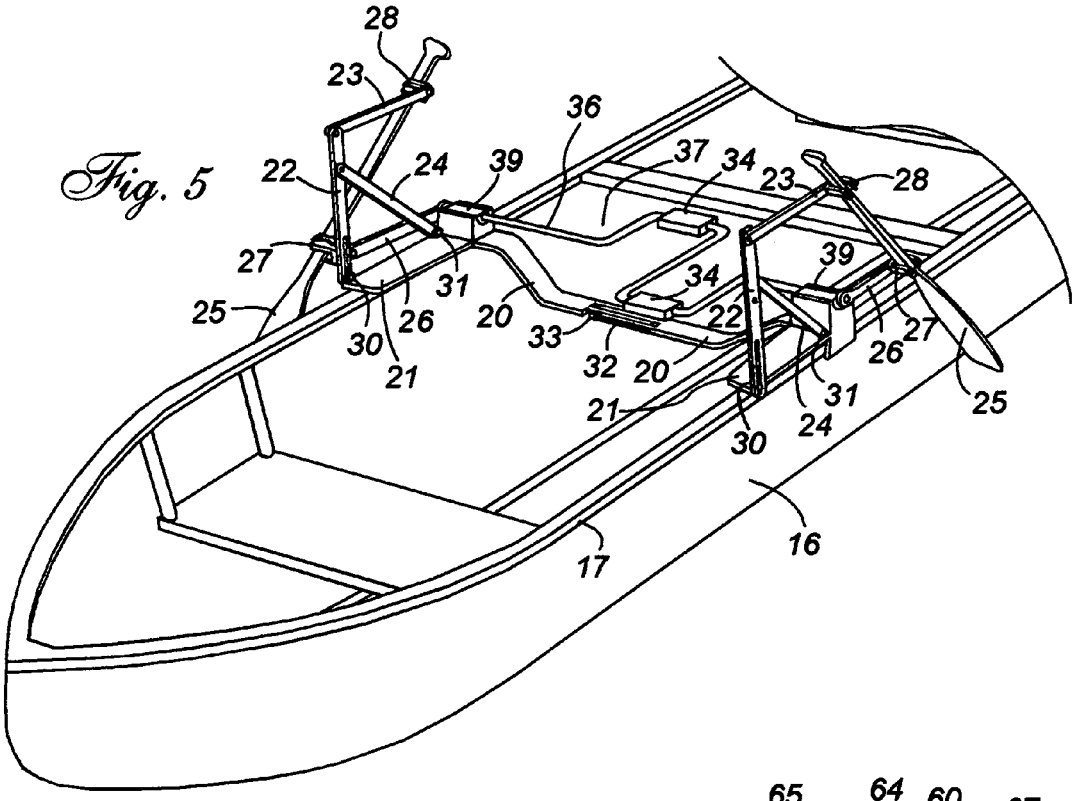
FIG. 5 is a partial rear perspective view from above of the biomechanically correct pedal powered paddling system for small watercrafts of the present invention.

FIG. 5, a partial perspective view from the rear of the biomechanically correct pedal powered paddling system for small watercrafts of the present invention better illustrating the assembly of the present invention onto a canoe 16 wherein, a watercraft attaching frame 20 securedly yet releasably attached to the gunwale 17 of said canoe 16. The frame 20 comprises two mirror opposite portions, each have a horizontal central portion, a diagonal portion extending upwardly and outwardly from the central portion, and a horizontal clamp portion, is so formed to allow sufficient clearance for rotational movement of the pedal members of the pedal assembly and said frame 20 is integral in maintaining vertical and horizontal parallel alignment to both left and right sides in respect to the alignment and shape of the watercraft. The frame 20 is made to adjust to the varied width of conventional watercrafts by means of slotted multi-tongue members 32 adapted to slidably engage to each opposing frame member and secured to each other with bolts 33 thus creating a larger contact surface area thereby preventing displacement between each frame 20 member.

A pedal drive assembly 37 having two foot pedals 34 both offset on the same plane and integrally attached to a drive member, which rotates on a horizontal axis perpendicular to the canoe's 16 length, a bearing portion 39 at each end distal from the foot pedals 34, drive extension members 36 having deep female end and a male end wherein the female end having a generally square inner form is adapted to slidably but non-rotationally engage with the outer surface of the pedal drive 37, and the male end of the pedal drive extension 36 is partly threaded to accept a nut after traversing the crank arm 26 thus preventing rotational freedom of crank arm with pedal drive extension 36. Two frame extension portions 21 extending rearwardly from each upper outermost portion of said frame 20 integrally include a front bracket 31 and a rear bracket wherein the front bracket 31 serves to rotationally attach the lower portion of a diagonal support 24, and the rear bracket serves to also rotationally attach the lower portion of a vertical arm 22 on which the upper portion of the diagonal support 24 in turn rotationally attaches to a perforation in the upper-mid section of the vertical member 22 thereby resulting is a triangular structure formed between the frame extension 21, the vertical member 22 and the diagonal support 24.

A drive crank 26 is non-rotationally engage to the outermost end of the pedal drive assembly, and its other end pivotally engaged to the lower paddle clamp 27 thus, when rotational force is created by a paddler, the pedal assembly thereby rotates the drive crank 26, which in turn exerts a rotational force at a circumferential motion on paddle clamps 28 rotationally attached to the ends of the drive crank 26. Said paddle clamps 28, are frictionally attached to the lower mid portion of a conventional paddle 25.

Figure 6:
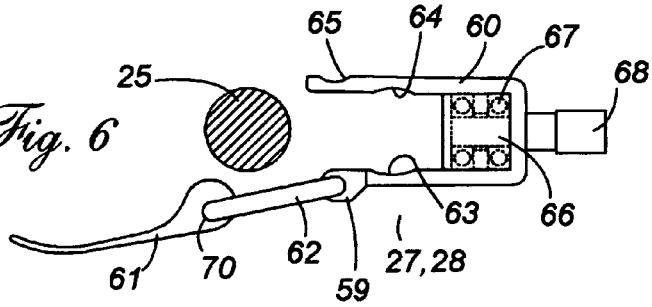
FIG. 6 is a side elevation view of a paddle clamp of the biomechanically correct pedal powered paddling system for small watercrafts of the present invention in an opened position.
Figure 7:
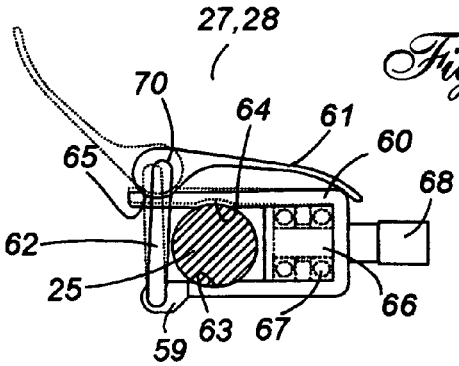
FIG. 7 is a side elevation view of a paddle clamp of the biomechanically correct pedal powered paddling system for small watercrafts of the present invention in an closed position.

Turning now to FIGS. 6 and 7, both illustrating a paddle clamp 27 or 28 of the biomechanically correct pedal powered paddling system for small watercrafts of the present invention wherein, FIG. 6 illustrating said clamp in an opened position, and FIG. 7 in a closed or locked position. The paddle clamps 27 or 28 comprise: a body portion 60 having a generally U-shaped form made of a relatively resilient material, a hinge portion 59, one or more inner paddle cradles 63 and 64, and an outer clamp cradle 65, a two axis hinge 62, a locking level 61 having an off-center hinge axis 70, an axle 66, swivel bearing 67, and a connecting member 68.

In its opened position, the paddle clamp 27 or 28 is poised to receive a paddle 25 handle between its inner paddle cradles 63 and 64. Once the paddle 25 is in place, the two-axis hinge 62 is pulled over the body portion 60 and the locking lever's 61 knuckle placed into the outer clamp cradle 65, the locking lever 61 is then turned over the body 60 wherein the off-center hinge axis portion 70 applies compression to the paddle handle 25. The axle 66, being rotationally engaged within the body portion 60 and fixedly attached to a corresponding swing lever or crank arm allows free rotational motion of the clamps 27 or 28 from the axle 66 and its attached members.

Figure 8:
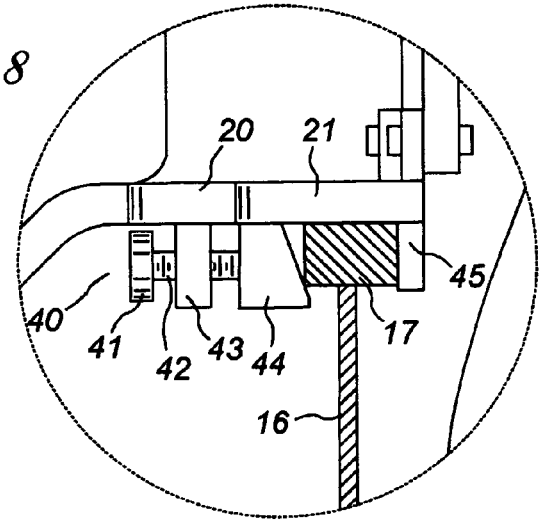
FIG. 8 is a selected view taken from FIG. 1 of the frame clamp device of the biomechanically correct pedal powered paddling system for small watercrafts of the present invention.

Turning to FIG. 8, a partial rear elevation view selected from FIG. 3, illustrates more closely, the details of watercraft-attaching portion of the frame 20 wherein an outer clamps member 45 abuts the outer surface of a canoe's 16 gunwale 17 and the lower surface of said frame 20 rests atop said gunwale 17. A female inner clamp member 43 fixedly attached to the underside of the frame 20 rotationally mated a like-threaded turn screw 40 having a knob 41 and a threaded bolts 42 fixedly attached to said knob 41. A compression block 44 rotationally engaged to said threaded bolt 42 but not threaded to allow rotational motion and not threadedly engaged to said threaded bolts 42, compresses against the inner surface of the gunwale 17 thus clamping said frame 20 firmly to the canoe's 16 gunwale 17. A taper is provided on the gunwale-contacting portion of the compression block, which prevents slippage of clamp assembly from the gunwale 17.

Figure 9:
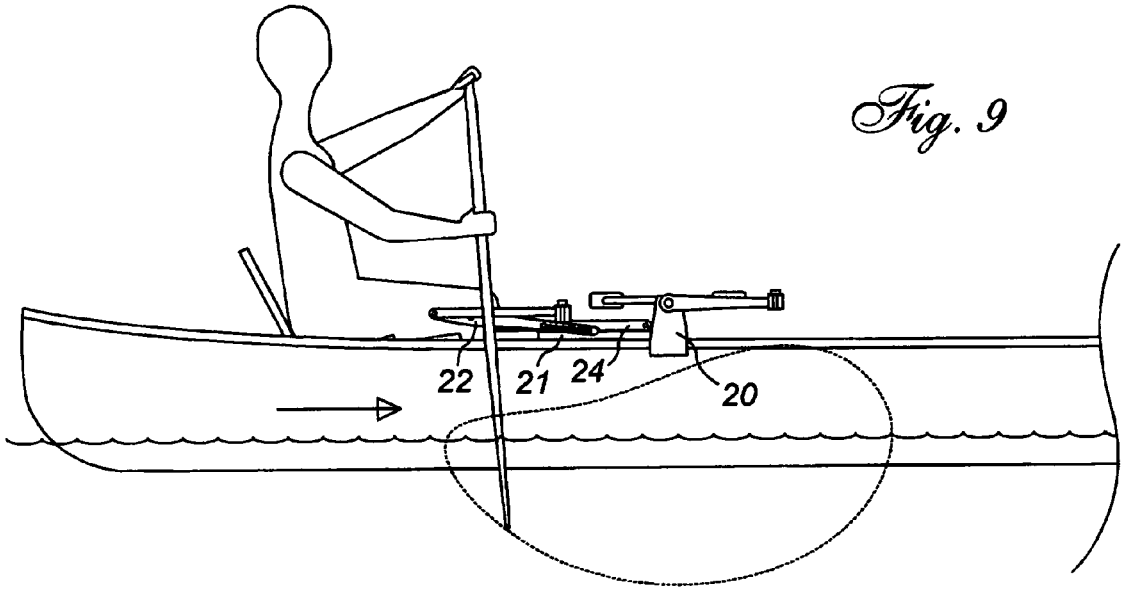
FIG. 9 is a partial side elevation view of the biomechanically correct pedal powered paddling system for small watercrafts of the present invention in a collapsed position.

Turning to FIG. 9, which depicts an option of the present invention is so far as, said system can be easily folded down when user wishes to paddle by hand. This is sometimes necessary when paddling in shallow waters or narrow water paths. In order to fold down the system, the user simply disconnects disconnect the upper connector of both diagonal supports 24, loosens the lower connector of the vertical member 22 and folds down the assembly against the extension portion 21 of the frame 20.

Therefore in resolution of the above specification of the present invention, anyone with a small watercraft such as a canoe with two paddles can quickly and easily adapt said watercraft and benefit from the features and utility of the present invention.

The invention claimed is:

1. A biomechanically correct pedal powered paddling system for small watercrafts comprising:

a. a watercraft attaching frame having:
   i. a central width-adjustable joining portion,
   ii. two opposing watercraft-clamping members for attaching said frame to watercraft gunwale,
   iii. two opposing pedal-assembly receiving portions,
   iv. two opposing primary linkage pivoting collapsible members,
   v. a diagonal support member forming a rigid, generally-triangular structure,
   vi. frame extension extending perpendicularly from each end portion of said frame,
   vii. two opposing secondary linkage folding members, and
   viii. a plurality of pivotal axle members,
b. a pedal drive assembly having;
   i. a primary pedal drive shaft having extension receiving female members at each end,
   ii. two drive shaft extensions having non-rotatable male ends longitudinally adjustably mating with female drive shaft members and paddle drive members distal from the primary drive shaft, and
   iii. two foot pedals rotably attached to offset member integral with a pedal drive shaft forming the crank member,
c. an upper and lower paddle-attaching portion each having:
   i. a paddle receiving portion,
   ii. a linkage attaching portion having single axis rotational freedom from paddle receiving portion, and
   iii. releasable paddle locking member,
d. a linkage array having:
   i. a paddle crank arm having a non-rotational female end adapted to receive the male end of the drive shaft extensions, and a rotational end adapted to secure to the linkage attaching portion of the above paddle receiving portion,
   ii. a swing lever,
   iii. a vertical member, and
   iv. a plurality of pivotal axle members,
e. the paddling system thus allows simulation of the biomechanical motion of conventional arm powered paddling by mechanically duplicating the ideal geometry and moments generated by the human act of paddling a canoe-like watercraft.

2. The biomechanically correct pedal powered paddling system of claim 1 wherein the pedal drive assembly comprises a drive extension at each end thereof having a longitudinally slidable non-rotational joint therebetween.

3. The biomechanically correct pedal powered paddling system of claim 1 wherein the paddle crank arm is rotably driven by force generated by rotational motion of the pedal drive assembly.

4. The biomechanically correct pedal powered paddling system of claim 1 wherein upper and lower paddle clamps are adapted with a quick-release apparatus for easy removal of said paddles.

5. The biomechanically correct pedal powered paddling system of claim 1 wherein simulation of the biomechanical motion of conventional arm powered paddling is achieved by a compound motion generated by a dual axis-dual pivot further comprising a lower paddle-connecting point pivotally attached to an extremity of a rotating crank arm, and an upper paddle-connecting point pivotally attached to the extremity of a swing lever.

6. The biomechanically correct pedal powered paddling system of claim 5 wherein the lower-mid section of a paddle follows a circular orbit about a center point of the drive crank arm, and the upper section of the paddle follows a semi-circular arc about a center point of the swing lever where said arc center point is locate generally above the drive crank arm center.

7. The biomechanically correct pedal powered paddling system of either claim 1, 2, 3, 4, 5, or 6 wherein use thereof is for propelling a small watercraft using ones leg power while simulating the biomechanical motion of conventional arm powered paddling.

8. The biomechanically correct pedal powered paddling system of either claim 1, 2, 3, 4, 5 or 6 wherein a user can quickly disable the system by disconnecting the paddles from each rotating crank and swing lever, disengaging the diagonal support member at one end, and folding down the vertical members against the upper portion of the watercraft attaching frame assemblies.

* * * * *